United States Patent [19]

Ingro

[11] 4,230,647

[45] Oct. 28, 1980

[54] CARBURETION

[76] Inventor: Ben Ingro, 2437 N. 73rd Ave., Elmwood Park, Ill. 60635

[21] Appl. No.: 14,924

[22] Filed: Feb. 26, 1979

Related U.S. Application Data

[63] Continuation-in-part of Ser. No. 815,594, Jul. 14, 1977, abandoned, which is a continuation-in-part of Ser. No. 619,685, Nov. 6, 1975, abandoned, which is a continuation-in-part of Ser. No. 460,543, Apr. 12, 1974, abandoned.

[51] Int. Cl.[2] ..... F02M 29/00

[52] U.S. Cl. ..... 261/78 R; 261/DIG. 55

[58] Field of Search ..... 261/76, 78 R, DIG. 55; 48/180 R, 180 B, 180 H, 180 M; 123/120, 141

[56] References Cited

U.S. PATENT DOCUMENTS

| | | | |
|---|---|---|---|
| 1,099,714 | 6/1914 | Munden | 261/78 R |
| 1,335,665 | 3/1920 | Deppé | 261/78 R X |
| 1,435,043 | 11/1922 | Ackley | 261/DIG. 55 X |
| 2,618,541 | 11/1952 | Aleman et al. | 123/141 X |
| 3,042,016 | 7/1962 | Christian | 123/122 AA X |
| 3,875,918 | 4/1975 | Loynd | 123/141 |

*Primary Examiner*—William A. Cuchlinski, Jr.

[57] ABSTRACT

An air-fuel mixing device adapted to be disposed between the carburetor throttle valve and the intake valve of an internal combustion engine comprising a housing, which is larger in diameter than the diameter of either the inlet or the outlet thereto, or therefrom, which inlet communicates with the air-fuel outlet passage of a carburetor and which outlet opening communicates with the intake opening of an intake manifold. Because of the size and shape of the mixing chamber, the air-fuel mixture therein is mixed by divergence and convergence of the air-fuel flow and since the chamber is substantially devoid of any baffles or protuberances, a whirlpool effect of the air-fuel flow is present because of the natural forces of gravity.

5 Claims, 11 Drawing Figures

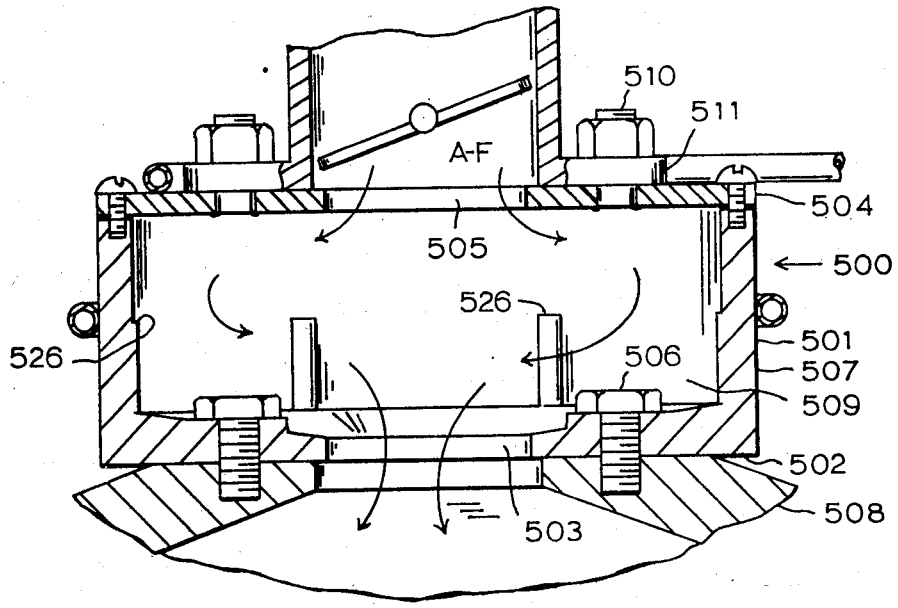
FIG. 3
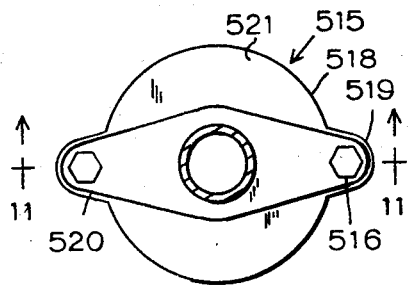
FIG. 4
FIG. 5
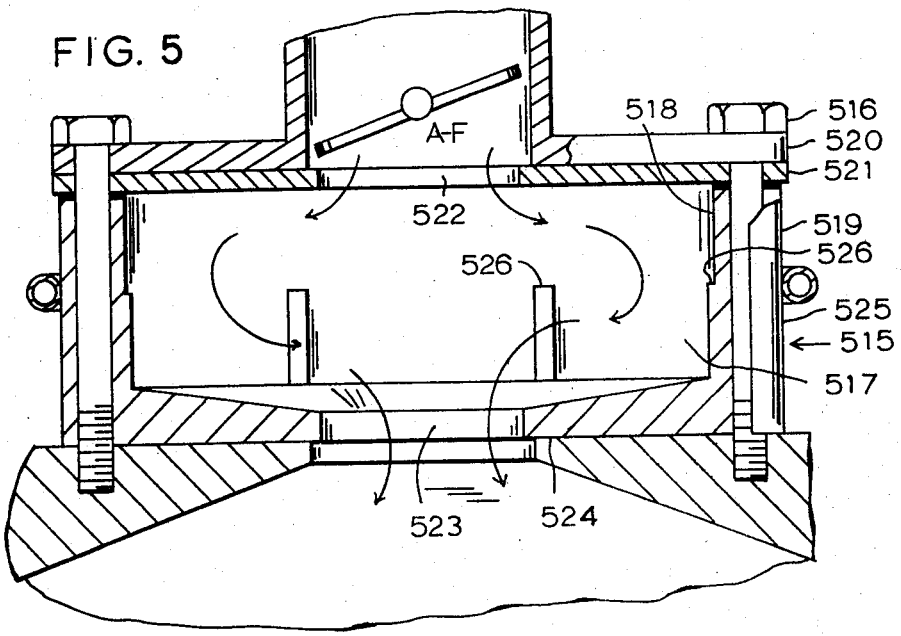

CARBURETION

RELATED APPLICATIONS

This is a continuation in part of Application Ser. No. 815,594 filed July 14, 1977 now abandoned which was based on continuation in part Application Ser. No. 619,685 filed Nov. 6, 1975 now abandoned which is a C-I-P of Application Ser. No. 460,543 filed April 12, 1974 now abandoned.

BACKGROUND OF THE INVENTION

This invention relates to improvements in air-fuel mixing devices. More specifically, it relates to air-fuel mixing devices which are disposed between a carburetor throttle valve and the intake valve of an internal combustion engine. The object of the air-fuel mixing device is to break the liquid fuel into smaller particles and to thoroughly and uniformly mix them with the air supply, which, in turn, provides more power, better mileage, faster acceleration and less noxious emissions (air pollution).

In the prior art, attempts have been made to improve carburetion techniques by installing devices between the carburetor and the intake manifold. Some have used heat means and some have used baffle means and some have used a combination of both. It is noted that such devices have not to any extent been practical due to the fact that such devices restrict and obstruct the flow of the air-fuel mixture to the engine with the result of interfered acceleration rate and of a fuel starved engine or with the result of an over-rich mixture of pre-ignition and gas knock which, in turn, results in power loss and engine and valve damage.

SUMMARY OF THE INVENTION

This invention has for its purpose the causing of a turbulent mixture of the air-fuel supply to the intake manifold without restricting or obstructing its flow thereto. The invention comprises a housing which is disposed between the carburetor, downstream of the throttle valve, and the intake manifold, which housing provides a mixing chamber which is, preferably, in axial vertical alignment and communication with the outlet of the carburetor barrel and with the inlet of the intake manifold. The mixing chamber within the housing is substantially larger in diameter than the diameter of the carburetor barrel and the diameter of the intake manifold inlet. The height of the mixing chamber is substantial in order to allow the air-fuel stream to flow in the chamber with a minimum of restriction or obstruction. The mixing chamber is formed to provide forceful mixing of the air-fuel supply by turbulence means because of the divergence and convergence of the air-fuel mixture and because of the whirl-pool effect of the air-fuel stream. In one embodiment of the invention, heat means are provided on the outer wall surface of the housing to hasten vaporization of the fuel in the mixing chamber. Also, the upper surface of the bottom wall of the mixing chamber is angled downwardly toward the outlet opening to allow any residual liquid fuel to drain toward said opening and into the intake manifold.

BRIEF DESCRIPTION OF THE DRAWING

FIG. 3 is a cross-sectional, side elevational view of another form of the invention;

FIG. 4 is a top plan view of another form of the invention;

FIG. 5 is a cross-sectional side elevational view of the device shown in FIG. 4 taken substantially along lines 5—5 in FIG. 4;

In FIG. 8 only the upper portion of the mixing chamber housing is formed integrally with the carburetor;

In FIG. 11 only the lower portion of the mixing chamber housing is formed integrally with the intake manifold.

DESCRIPTION OF THE PREFERRED EMBODIMENT

Figure 1:
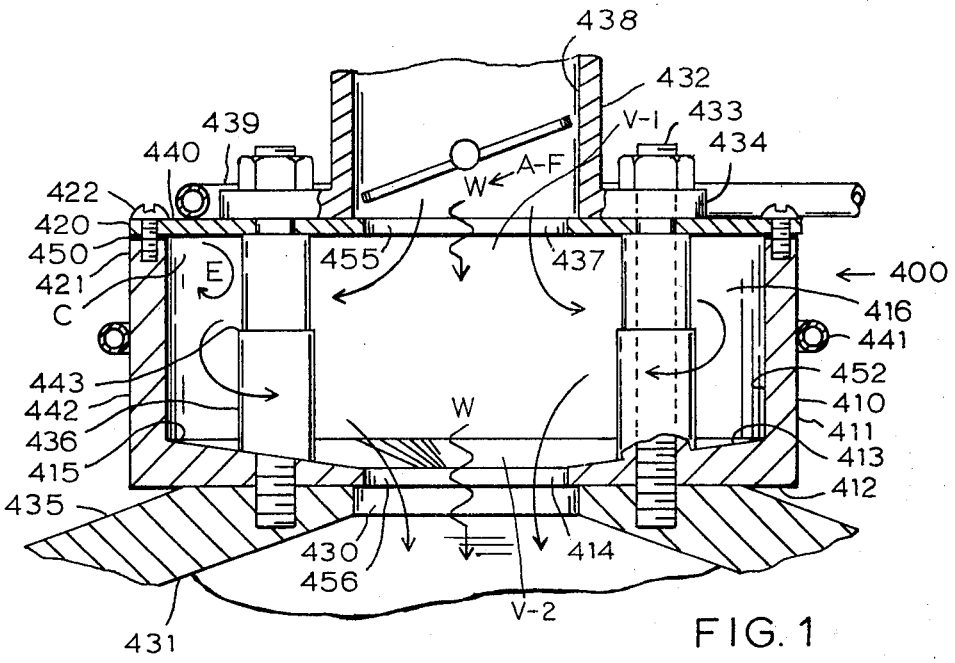
FIG. 1 shows one form of the invention which is a cross-sectional side elevational view of the air-fuel mixing chamber taken substantially along lines 1—1 of FIG. 2.
Figure 2:
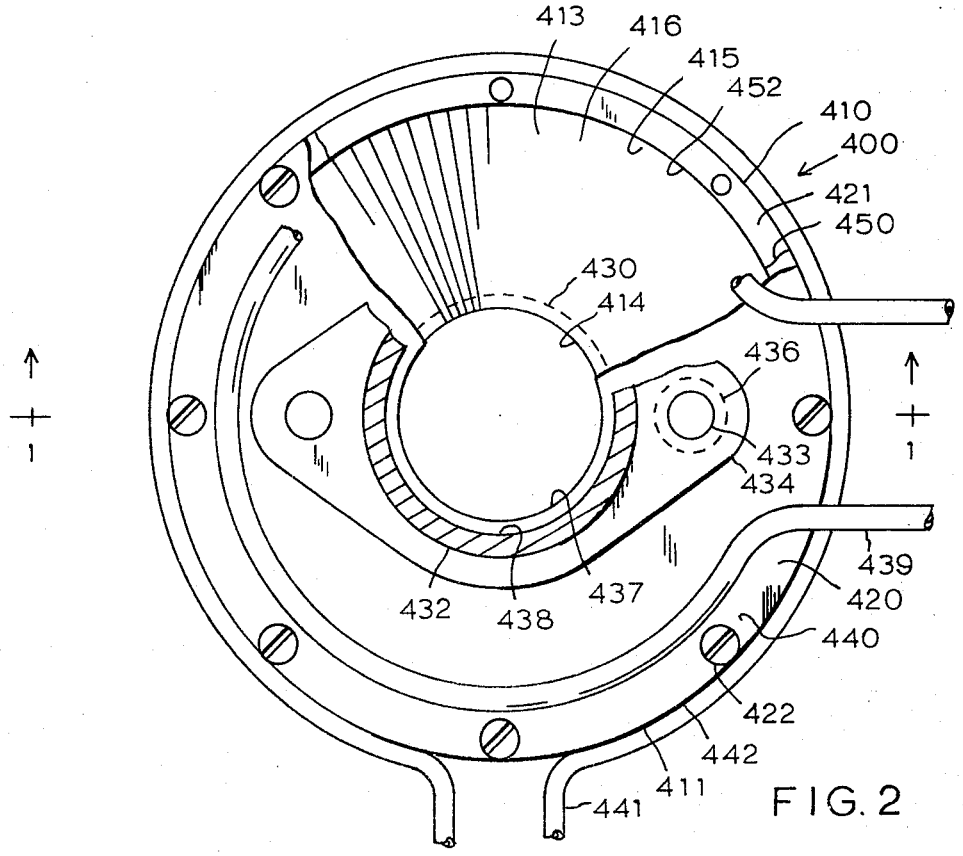
FIG. 2 is a partially torn-away top plan view of the device shown in FIG. 1.

Referring to FIGS. 1 and 2, there is shown an air-fuel mixing device 400 which is constructed in accordance with the principles of this invention. As shown in FIG. 1, a cast housing 410 comprises the circumferential side wall 411 and the bottom wall 412 of the air-fuel mixing device 400. The upper surface 413 of the bottom wall 412 angles downwardly towards the centrally located outlet opening 414 to channel gases and any liquid fuel toward said outlet opening 414 and to prevent any liquid fuel from settling in the lower portions 415 of the mixing chamber 416. A top plate which forms the upper wall 420 is provided to close off the open upper end 421 of the housing 410. The plate 420 can be attached to the upper end 421 of the housing 410 by means of screws 422 which are arranged along the perimeter of plate 420. The air-fuel mixing device is secured at the intake opening 430 of the intake manifold 431, and the carburetor 432, in turn, is secured to the opposite side of the air-fuel mixing device 400. The entire assembly is secured together by mounting bolts or studs and nuts 433 which traverse the carburetor flanges 434 and the air-fuel mixing device 400. The bolts or studs 433 are threaded into the intake manifold 435. The bolts 433 are journalled through the spacers 436 which are provided in the air-fuel mixing chamber 416. The spacers 436 serve to prevent downward deformation of the top plate 420 when the bolts 433 are tightened and also serve to provide a secure foundation for the carburetor 432.

The top plate 420 has a centrally located inlet opening 437 which is in communication with the barrel 438 of the carburetor 432. The outlet opening 414 in the bottom wall 412 of the air-fuel mixing device 400 is in communication with the intake opening 430 of the intake manifold 431. The opening 437 and 438 and openings 414 and 430 are preferably in vertical axial alignment.

If desired, the air-fuel mixing device may be heated by the addition of a tube 439 which may be soldered or otherwise bonded to the outside surface 440 of the top plate 420 or by a tube 441 which is bonded to the outside surface 442 of the side wall of the housing 410. The tubes 439 and/or 441 may conduct heat to the housing 410 in the form of hot coolant or hot exhaust gases or by electrical means from the operation of the engine.

Necessary gaskets may be provided where needed, for example, between the carburetor flanges 434 and the top wall 420 of the air-fuel mixing device and between the bottom wall 412 of the air-fuel mixing device and the intake manifold 431 and between the top plate 420 and the upper end 421 of the housing 410 which is shown as gasket 450.

Referring to FIGS. 1 and 2, with the engine in operation, the air-fuel mixture A–F enters the mixing chamber 416 through the top inlet opening 437. Upon entering the mixing chamber 416, the air-fuel mixture A–F diverges outwardly toward the inner wall surfaces 452 of the side wall 411 of the housing 410. The air-fuel mixture then re-converges and passes through the bottom outlet opening 414 of the mixing chamber 416 and then to the intake manifold inlet 430. While the air-fuel mixture stream is passing through the mixing chamber 416, heavier droplets will be thrown against the inner wall surface 452 of the side walls 411 and the top wall surface 413 of the bottom wall 412, where the droplets will be evaporated therefrom by the passing air-fuel mixture stream and be further mixed with said stream.

The whirl-pool effect W is provided by the force of gravity.

As the air-fuel mixture stream A–F passes through the inlet opening 437 of the mixing chamber 416, it has high speed and low density. As it passes through the mixing chamber 416, it slows down and has greater density. As the air-fuel mixture stream A–F passes through the bottom outlet opening 414, it again has high speed and less density. The expansion and contraction of the air-fuel mixture stream, coupled with the divergence and convergence flow pattern and the change in flow, helps in mixing the fuel with the air supply.

Referring to FIG. 3, there is shown another form of the invention. Shown is a cross-sectional side elevational view of an air-fuel mixing device 500 which is similar to and operates in the same way as the air-fuel mixing device 400 shown in FIGS. 1 and 2. The main difference is that the mounting bolt arrangement is different. As shown in FIG. 1, the mounting bolts 433 and spacers 436 traverse the mixing chamber 416 and may therefore interfere slightly with the desired air-fuel flow pattern. The obstruction has been omitted in the device shown at 500.

The air-fuel mixing device 500 preferably has a cylindrical side wall 501, a bottom wall 502, and outlet opening 503 in said bottom wall 502 and a top plate 504. The top plate 504 has an inlet opening 505. Short bolts 506 are used to secure the air-fuel mixing chamber housing 507 to the intake manifold 508. Only the heads of the bolts 506 protrude into the mixing chamber 509. The top plate 504 is provided with a pair of studs 510 which are press-fitted and welded into holes in the top plate 504. The threaded end of the studs 510 extend upwardly to traverse the carburetor flanges 511 and are fitted with nuts.

FIGS. 4 and 5 show another form of the invention as designated by numeral 515. FIG. 4 is a top plan view and FIG. 5 is a cross-sectional side elevational view taken along lines 5—5 in FIG. 4. As shown, the mounting bolts 516 are completely out of the mixing chamber 517 and are located instead at the perimeter of the side walls 518 of the housing. That portion of the side wall 518 is thickened at that point 519 to receive the bolts 516. The carburetor flanges 520 are elongated to cooperate with the outward position of the bolts 516. A top plate 521 is provided which has an inlet opening 522. An outlet opening 523 is also provided in the bottom wall 524 of the housing 525.

The air-fuel mixing devices shown in FIGS. 1, 2 and 3 may be mounted on stock intake manifolds and use stock carburetors.The air-fuel mixing device 515, shown in FIGS. 4 and 5, can be mounted on an intake manifold which is especially constructed to support the device 515. The intake manifold would have further than normal spaced apart holes for receiving the mounting bolts 516. The carburetor must also be modified to provide the longer flanges 520.

Figure 7:
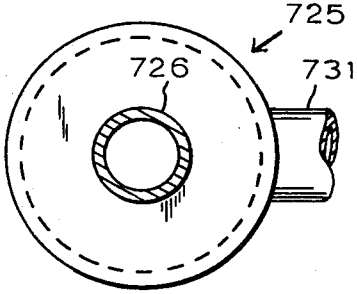
FIG. 7 is a top plan view of the mixing chamber shown in FIG. 6 and taken substantially along lines 7—7 in FIG. 6.
Figure 6:
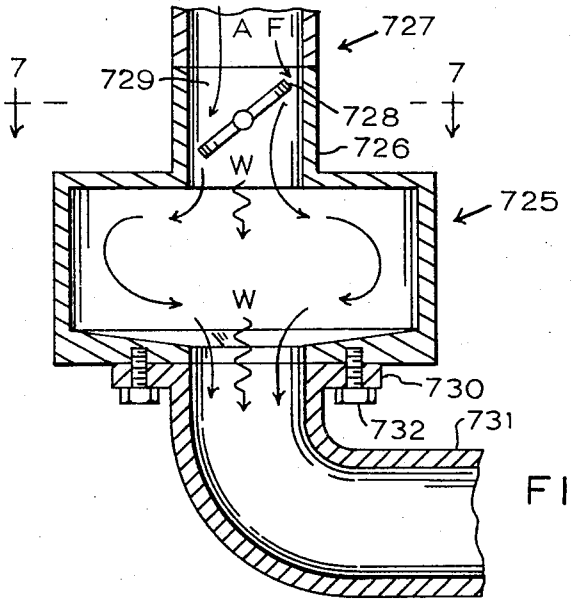
FIG. 6 is a cross-sectional side elevational view of another form of the invention. In this form the air-fuel mixing chamber housing is formed integrally with a portion of the carburetor.

In FIGS. 6 and 7 is shown another form of the invention. FIG. 6 is a cross-sectional side elevational view and FIG. 7 is a top plan view taken substantially along lines 7—7 in FIG. 6. In this form the mixing chamber 725 is formed integrally with the air-fuel outlet casting 726 of the carburetor 727 which houses the throttle valve 728. Modern carburetors are usually made in several sections and bolted together. The upper section is usually referred to as the air horn and serves as the air inlet of the carburetor. The mid-section is usually referred to as the bowl or float section and houses the venturi in the air-fuel passage. The lower section 726 is usually referred to as the outlet flange or the outlet casting and houses the throttle valve 728 in the air-fuel outlet passage 729 in the outlet casting 726. The carburetor 727 with the air-fuel mixing chamber 725 formed integrally with said outlet casting 726 is bolted on a mating air-fuel inlet flange 730 of the intake manifold 731 by means of bolts 732 on the underside of the mixing chamber 725.

Figure 8:
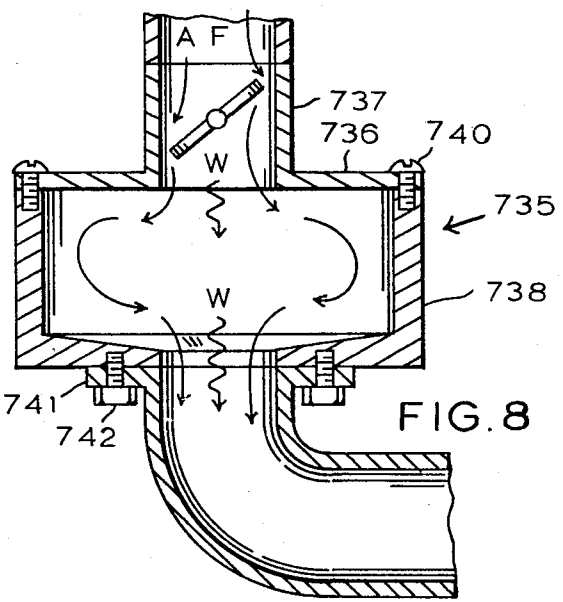
FIG. 8 is a cross-sectional side elevational view of another form of the mixing chamber housing shown in FIGS. 6 and 7.

However, for ease in casting during the manufacturing process the mixing chamber can be made in two sections as shown in FIG. 8. In FIG. 8 the mixing chamber 735 has its upper horizontal wall 736 formed integrally with the carburetor outlet casting 737. The upper wall 736 is bolted onto the body 738 of the mixing chamber 735 by means of bolts 740 which traverse holes in the perimeter of the upper horizontal wall 736 of the mixing chamber and through tapped holes in the perimeter of the upper wall of the mixing chamber body 738. The body 738 can be bolted onto the intake manifold flange 741 from the underside by means of bolts 742.

Figure 10:
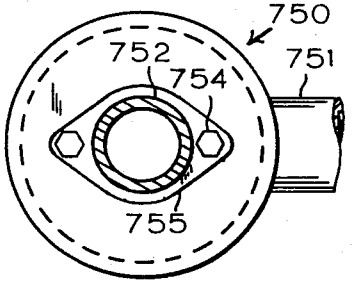
FIG. 10 is a top plan view of the mixing chamber shown in FIG. 9 and taken substantially along lines 10—10 in FIG. 9.
Figure 9:
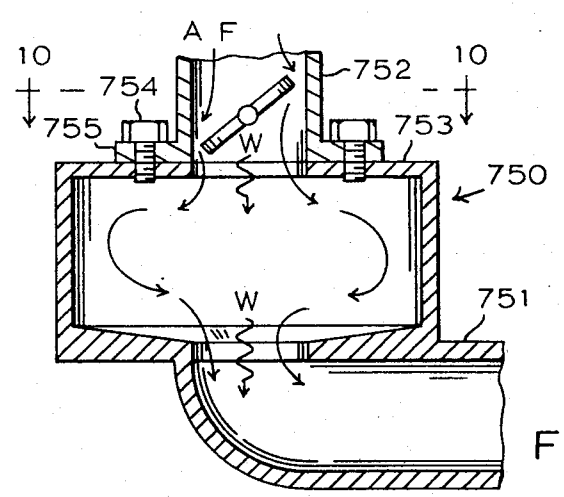
FIG. 9 is a cross-sectional side elevational view of another form of the invention in which the mixing chamber housing is formed integrally with the intake manifold.

FIGS. 9 and 10 show another form of the invention. In this form the mixing chamber 750 is formed integrally with the intake manifold 751.

FIG. 9 is a cross-sectional side elevational view and FIG. 10 is a top plan view taken substantially along lines 10—10 in FIG. 9. The carburetor 752 is bolted on the upper horizontal wall 753 by means of bolts 754 which traverse the air-fuel outlet flange or casting 755 of the carburetor 752.

Figure 11:
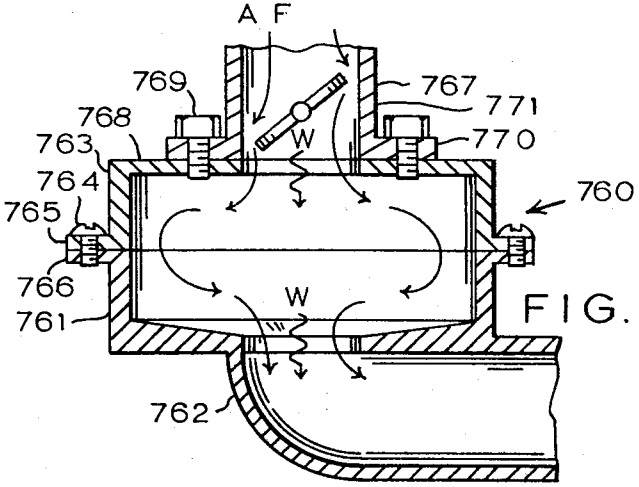
FIG. 11 is a cross-sectional side elevational view of another form of mixing chamber housing shown in FIGS. 9 and 10.

However, for ease in casting during the manufacturing process the air-fuel mixing chamber can be made in two sections as shown in FIG. 11. In FIG. 11, the mixing chamber 760 has its lower portion 761 formed integrally with the intake manifold 762. The upper portion 763 of the mixing chamber 760 is bolted onto the lower portion 761 by means of bolts 764 which traverse circumferential flanges 765 and 766 of the upper and lower portions of the mixing chamber 760. The carburetor 767 is bolted onto the upper horizontal wall 768 of the mixing chamber 760 by means of bolts 769 which traverse flanges 770 of the outlet casting 771 of the carburetor 767.

It is shown in FIGS. 6, 8, 9 and 11 that the divergence and convergence (long arrows) and the whirlpool effect (W) is essentially the same as shown in FIG. 1.

In this invention, "intake manifold" is any passage which carries air-fuel mixture from the carburetor throttle valve to the intake valve of one or more combustion chambers of the engine. In some applications, a carburetor may be connected in close proximity to the intake valve of the engine, therefore, the air-fuel passage between the carburetor throttle valve and the intake valve of the engine would also be termed "intake manifold" regardless of how short or how long the passage is and regardless of how many branches it has.

The devices disclosed offer a high degree of turbulence and mixing capabilities with a minimum of obstruction to the flow of the air-fuel mixture. The cross-section of the air-fuel passage through the narrow-most portion of the mixing chamber should be at least equal, dynamically, to the cross-section of the carburetor barrel and the cross-section of the intake manifold opening. The design of the mixing chambers shown permit an engine to "breathe freely" at all usual R.P.M.'s.

If vacuum guages V1 and V2 are connected near the inlet and outlet openings of the invention, as shown in FIG. 1, and the vehical is downshifted for passing at highway speed, there would be only a slight difference in vacuum between the two guages indicating a high efficiency and low obstruction to the flow of the air-fuel mixture.

It will be appreciated that other modifications and variations may be effected without departing from tne spirit and scope of the novel concepts of this invention.

I claim:

1. In combination with an air-fuel intake system for internal combustion engines comprising a downdraft carburetor which forms the only restricting device in the flow of the air-fuel mixture to the engine, said carburetor having an air-fuel outlet passage in its lower portion, a throttle valve disposed in said outlet passage for controlling the amount of finalized air-fuel mixture flowing to said engine, an intake manifold having an air-fuel passage therein which communicates with said carburetor outlet passage adapted to deliver said air-fuel mixture to said engine, and an intake valve and cooperating intake port disposed between said intake manifold passage and the combustion chamber of said engine, said intake manifold said upper inlet opening and said lower outlet passage in said air-fuel mixing chamber being substantially on the same vertical axis, said air-fuel mixing chamber being adapted in one mode to cause an upper horizontally and radially extending divergence of flow of said air-fuel mixture in said mixing chamber as said mixture enters said mixing chamber through said upper inlet opening with said mixture being caused to turn downwardly at the perimeter of said mixing chamber, and further causing said air-fuel mixture to converge below the upper diverging flow to exit through the lower outlet passage in said mixing chamber and into said intake manifold passage, said divergence and convergence flow pattern also being effective to cause any heavier liquid fuel particles to impinge on the upper floor surface of said lower horizontal wall member where said particles are evaporated from said surface, said divergence and convergence flow pattern being minimized in another mode during periods of acceleration when the throttle valve is suddenly moved to a more open position and the vacuum in said mixing chamber is caused to drop appreciably during said periods of acceleration, the flow path in said mixing chamber being substantially and unrestrictedly "straight through" between the inlet opening and the outlet passage of said mixing chamber, said air-fuel mixing chamber being substantially devoid of any members therein which would cause divergence and convergence passage and said intake valve port comprising a substantially unrestricted air-fuel passage from said carburetor outlet passage to said combustion chamber; wherein an air-fuel mixing chamber is provided in said intake manifold passage downstream of said throttle valve, said air-fuel mixing chamber including a substantially horizontally disposed upper wall member, said upper wall member having an air-fuel inlet opening which communicates with said carburetor air-fuel outlet passage, a substantially horizontally disposed lower wall member, said lower wall member having an air-fuel outlet passage communicating with said intake manifold air-fuel passage, said lower wall member having an upper floor surface which angles downwardly toward said air-fuel outlet passage for draining any residual liquid fuel into said intake manifold passage, means for joining said upper and lower wall members at their perimeters to form a leakproof housing which encompasses said air-fuel mixing chamber, said upper air-fuel inlet opening being substantially the same diameter as said outlet passage of said carburetor, said lower air-fuel outlet passage of said mixing chamber being substantially the same diameter as said carburetor outlet passage, the height of said mixing chamber between said upper inlet opening and said lower outlet passage of said mixing chamber being at least greater than the diameter of said upper inlet opening, the width of said air-fuel mixing chamber being at least greater than the diameter of said upper inlet opening of said air-fuel mixing chamber, flow pattern, and having unrestricted air-fuel passages therein, and being devoid of functional elements therein other than structural members which would tend to obstruct the natural divergence and convergence flow pattern in said air-fuel mixing chamber, the diameter of said upper inlet opening of said air-fuel mixing chamber being substantially the same size as the diameter of the carburetor air-fuel outlet passage downstream of said throttle valve, said upper inlet opening serving as a functional reference diameter, the horizontal cross-sectional area of said air-fuel mixing chamber at all horizontal levels being at least greater than the area of said reference diameter, and the height of said air-fuel mixing chamber between said inlet opening and said outlet passage being at least greater than said reference diameter.

2. An air-fuel mixing chamber as defined in claim 1, wherein said air-fuel mixing chamber includes a housing adapted to be secured between the carburetor air-fuel outlet passage and the intake manifold air-fuel inlet opening.

3. An air-fuel mixing chamber as defined in claim 2, wherein said housing is formed in at least two sections, the first section forming at least the upper horizontal wall member with the inlet opening therein, and the second section including at least the lower horizontal wall member with the outlet passage therein.

4. An air-fuel mixing chamber as defined in claim 1, wherein said air-fuel mixing chamber includes a housing in which at least a portion of said housing is formed integrally with at least a portion of said carburetor.

5. An air-fuel mixing chamber as defined in claim 1, wherein said air-fuel mixing chamber includes a housing in which at least a portion of said housing is formed integrally with at least a portion of said intake manifold.

* * * * *

UNITED STATES PATENT AND TRADEMARK OFFICE

CERTIFICATE OF CORRECTION

PATENT NO. : 4,230,647

DATED : October 28, 1980

INVENTOR(S) : Ben Ingro

It is certified that error appears in the above—identified patent and that said Letters Patent is hereby corrected as shown below:

IN THE SPECIFICATION

Column 1, line 9: delete -- 619,685 --, insert -- 629,685 --.

Column 1, line 33: after "mixture" delete -- of --, insert -- or --.

Column 5, CLAIM 1 should read as follows:

1. In combination with an air-fuel intake system for internal combustion engines comprising a downdraft carburetor which forms the only restricting device in the flow of the air-fuel mixture to the engine, said carburetor having an air-fuel outlet passage in its lower portion, a throttle valve disposed in said outlet passage for controlling the amount of finalized air-fuel mixture flowing to said engine, an intake manifold having an air-fuel passage therein which communicates with said carburetor outlet passage adapted to deliver said air-fuel mixture to said engine, and an intake valve and cooperating intake port disposed between said intake manifold passage and the combustion chamber of said engine, said intake manifold passage and said intake valve port comprising a substantially unrestricted air-fuel passage from said carburetor outlet passage to said combustion chamber; wherein an air-fuel mixing chamber is provided in said intake manifold passage downstream of said throttle valve, said air-fuel mixing chamber including a substantially horizontally disposed upper wall member, said upper wall member having an air-fuel inlet opening which communicates with said carburetor air-fuel outlet passage, a substantially horizontally disposed lower wall member, said lower wall member having an air-fuel outlet passage communicating with said intake manifold air-fuel passage, said lower wall member having an upper floor surface which angles downwardly toward said air-fuel outlet passage for draining any residual liquid fuel into said intake manifold passage,

UNITED STATES PATENT AND TRADEMARK OFFICE

CERTIFICATE OF CORRECTION

PATENT NO. : 4,230,647

DATED : October 28, 1980

INVENTOR(S) : Ben Ingro

It is certified that error appears in the above—identified patent and that said Letters Patent is hereby corrected as shown below:

means for joining said upper and lower wall members at their perimeters to form a leakproof housing which encompasses said air-fuel mixing chamber, said upper air-fuel inlet opening being substantially the same diameter as said outlet passage of said carburetor, said lower air-fuel outlet passage of said mixing chamber being substantially the same diameter as said carburetor outlet passage, the height of said mixing chamber between said upper inlet opening and said lower outlet passage of said mixing chamber being at least greater than the diameter of said upper inlet opening, the width of said air-fuel mixing chamber being at least greater than the diameter of said upper inlet opening of said air-fuel mixing chamber, said upper inlet opening and said lower outlet passage in said air-fuel mixing chamber being substantially on the same vertical axis, said air-fuel mixing chamber being adapted in one mode to cause an upper horizontally and radially extending divergence of flow of said air-fuel mixture in said mixing chamber as said mixture enters said mixing chamber through said upper inlet opening with said mixture being caused to turn downwardly at the perimeter of said mixing chamber, and further causing said air-fuel mixture to converge below the upper diverging flow to exit through the lower outlet passage in said mixing chamber and into said intake manifold passage, said divergence and convergence flow pattern also being effective to cause any heavier liquid fuel particles to impinge

CERTIFICATE OF CORRECTION

Patent No. 4,230,647 Dated October 28, 1980

Inventor(s) Ben Ingro

It is certified that error appears in the above-identified patent and that said Letters Patent are hereby corrected as shown below:

on the upper floor surface of said lower horizontal wall member where said particles are evaporated from said surface, said divergence and convergence flow pattern being minimized in another mode during periods of acceleration when the throttle valve is suddenly moved to a more open position and the vacuum in said mixing chamber is caused to drop appreciably during said periods of acceleration, the flow path in said mixing chamber being substantially and unrestrictedly "straight through" between the inlet opening and the outlet passage of said mixing chamber, said air-fuel mixing chamber being substantially devoid of any members therein which would cause divergence and convergence flow pattern, and having unrestricted air-fuel passages therein, and being devoid of functional elements therein other than structural members which would tend to obstruct the natural divergence and convergence flow pattern in said air-fuel mixing chamber,

CERTIFICATE OF CORRECTION

Patent No. 4,230,647 Dated October 28, 1980

Inventor(s) Ben Ingro

It is certified that error appears in the above-identified patent and that said Letters Patent are hereby corrected as shown below:

the diameter of said upper inlet opening of said air-fuel mixing chamber being substantially the same size as the diameter of the carburetor air-fuel outlet passage downstream of said throttle valve, said upper inlet opening serving as a functional reference diameter, the horizontal cross-sectional area of said air-fuel mixing chamber at all horizontal levels being at least greater than the area of said reference diameter, and the height of said air-fuel mixing chamber between said inlet opening and said outlet passage being at least greater than said reference diameter.

Signed and Sealed this

*Twenty-first* Day of *April 1981*

[SEAL]

*Attest:*

RENE D. TEGTMEYER

*Attesting Officer* *Acting Commissioner of Patents and Trademarks*